US006920707B1

(12) United States Patent
Greene et al.

(10) Patent No.: US 6,920,707 B1
(45) Date of Patent: Jul. 26, 2005

(54) SYSTEM FOR MODIFYING PROPERTIES OF AN ARTICLE OF FOOTWEAR

(75) Inventors: Pamela S. Greene, Portland, OR (US); Christopher Cook, Portland, OR (US)

(73) Assignee: Nike, Inc., Beaverton, OR (US)

( * ) Notice: Subject to any disclaimer, the term of this patent is extended or adjusted under 35 U.S.C. 154(b) by 416 days.

(21) Appl. No.: 10/146,480

(22) Filed: May 14, 2002

(51) Int. Cl.[7] ..... A43B 3/26
(52) U.S. Cl. ..... 36/97; 36/28
(58) Field of Search ..... 36/97, 28, 30 R, 36/108, 31

(56) References Cited

U.S. PATENT DOCUMENTS

| | | | | |
|---|---|---|---|---|
| 641,642 | A | 1/1900 | Gunn | |
| 2,607,133 | A | 8/1952 | Marlowe | |
| 3,686,777 | A | 8/1972 | Rosen | |
| 4,391,048 | A | 7/1983 | Lutz | |
| 4,534,121 | A | 8/1985 | Autry | |
| 4,553,342 | A | 11/1985 | Derderian et al. | |
| 4,616,431 | A * | 10/1986 | Dassler | 36/28 |
| 4,843,741 | A | 7/1989 | Yung-Mao | |
| 4,858,340 | A | 8/1989 | Pasternak | |
| 4,905,382 | A | 3/1990 | Yung-Mao | |
| 4,908,962 | A | 3/1990 | Yung-Mao | |
| 4,918,838 | A * | 4/1990 | Chang | 36/28 |
| 4,967,492 | A | 11/1990 | Rosen | |
| 5,060,402 | A | 10/1991 | Rosen | |
| 5,101,580 | A | 4/1992 | Lyden | |
| 5,203,793 | A | 4/1993 | Lyden | |
| 5,241,762 | A | 9/1993 | Rosen | |
| 5,325,614 | A | 7/1994 | Rosen | |
| 5,369,896 | A * | 12/1994 | Frachey et al. | 36/29 |
| 5,404,658 | A | 4/1995 | Rosen | |
| 5,729,912 | A | 3/1998 | Gutkowski et al. | |
| 5,806,210 | A | 9/1998 | Meschan | |
| 5,815,949 | A * | 10/1998 | Sessa | 36/3 B |
| 5,826,352 | A | 10/1998 | Meschan et al. | |
| 5,970,628 | A | 10/1999 | Meschan | |
| 6,050,002 | A | 4/2000 | Meschan | |
| 6,324,772 | B1 | 12/2001 | Meschan | |
| 2004/0128861 | A1 * | 7/2004 | Durand | 36/97 |

FOREIGN PATENT DOCUMENTS

| | | |
|---|---|---|
| WO | 92/18023 | * 10/1992 |

* cited by examiner

*Primary Examiner*—Ted Kavanaugh
(74) *Attorney, Agent, or Firm*—Banner & Witcoff, Ltd.

(57) ABSTRACT

A system for modifying properties of an article of footwear is disclosed, wherein the article of footwear includes a removable foot-supporting member that includes a frame portion that defines an aperture, one of a plurality of insert portions that are received by the aperture, and a restraining member attached to an upper surface of the frame portion. By removing the insert portion, which has a specific physical characteristic, and replacing it with an alternate insert portion, which has a different physical characteristic, properties of the article of footwear are modified. The restraining member is attached to the upper surface of the frame portion, but not to the upper surface of the insert portion. The restraining member prevents upward movement of the insert portions and stretches to accommodate insert portions having various dimensions.

86 Claims, 10 Drawing Sheets

SYSTEM FOR MODIFYING PROPERTIES OF AN ARTICLE OF FOOTWEAR

BACKGROUND OF THE INVENTION

1. Field of the Invention

The present invention relates to a system for modifying properties of an article of footwear. The invention concerns, more particularly, articles of footwear having a foot-supporting member with replaceable inserts.

2. Description of Background Art

Modern articles of athletic footwear are generally fitted to specific individuals based solely upon the overall length of the foot. Foot dimensions, however, vary between individuals in respects that are not accounted for through consideration of length alone. As a result, many individuals may select footwear that is improperly-fitted and has the potential to cause discomfort or impair athletic performance.

The fit of an article of footwear is primarily influenced by the shape of the last upon which the footwear is formed. In creating a last, primary importance is given to foot measurements that include the overall length of the foot, width of the foot, height of the first digit, contour of the instep, and at least six girth measurements. In shaping a last for the manufacture of mass-produced footwear, designers utilize foot measurements from a broad spectrum of the population to determine the characteristics of a statistically-average foot. The measurements that comprise the statistically-average foot are then used to shape a last that theoretically achieves a proper fit for a majority of the population. Many individuals, however, do not have a foot with statistically-average proportions and would obtain benefits from footwear that accommodates their unique proportions. For the majority of these individuals, footwear that is offered in a variety of length-width combinations would provide a sufficient fit. Most footwear manufacturers, including manufacturers of athletic footwear, only provide consumers with footwear in limited length-width combinations. For a given length, therefore, most footwear manufacturers provide consumers with few options, if any, for different widths.

The primary factors that effectively prohibit manufacturers from offering footwear sizes in a variety of widths for each length relate to manufacturing costs and retail inventory. Each length-width combination for an article of footwear generally requires a unique last that is proportioned for the specific length-width combination. In addition to the cost of generating a relatively large number of lasts, further expenditures are required to alter the manufacturing system each time a different length-width combination is manufactured. The most expensive aspect, however, may be generating molds for midsole-outsole units that reflect a variety of length-width combinations for both the left and right foot. Such costs are generally reflected in the final price of the footwear and may make the footwear prohibitively expensive when compared to the cost of similar footwear that is not offered in a variety of widths. With regard to retail inventory, the cost of acquiring footwear in multiple length-width combinations and storing the inventory until sale effectively prohibits at least the smaller retailers from offering various length-width combinations. To ensure availability of specific sizes of footwear, retailers often purchase numerous pairs of footwear for each size that is based on length. When the typical inventory requirements are further multiplied by numerous widths, the size of the required inventory becomes increasingly large. Accordingly, both manufacturing costs and limitations upon retail inventory effectively prohibit manufacturers from offering a variety of widths for each size.

Providing footwear with a variety of length-width combinations may not provide a sufficient fit for individuals with foot proportions that change in relatively short periods of time. Children, for example, may experience rapid growth changes that prevent footwear from being worn for a significant portion of the footwear's useful life. Individuals with specific medical conditions, such as edema, may also experience changes in foot proportions. In addition, changes in foot proportions may occur during maternity.

In order to accommodate individuals that do not have feet with statistically-average proportions or proportions that change over time, some prior art footwear designs incorporate fit features that are adjustable. The prior art designs exhibit both automatic and manual mechanisms that permit adjustment of fit factors. An automatic mechanism adjusts by utilizing the pressure of the foot against the interior of the shoe. Usually adjusting for width, the typical automatic mechanism permits a vertical deformation of the upper to translate into a horizontal increase in width. Examples of patents displaying automatic mechanisms include U.S. Pat. Nos. 5,404,658 to Rosen; 5,325,614 to Rosen; 5,241,762 to Rosen; 5,060,402 to Rosen; 4,967,492 to Rosen; and 4,858,340 to Pasternak. Manual mechanisms require the wearer to adjust fit through means that include lacing systems, as in U.S. Pat. Nos. 4,553,342 to Derderian et al. and 641,642 to Gunn, or screw adjustments, as in U.S. Pat. Nos. 4,391,048 to Lutz; 3,686,777 to Rosen; 2,607,133 to Marlowe; and 5,729,912 to Gutkowski et al.

Although the prior art succeeds in supplying means for adjusting fit factors, most of the prior art designs are not suitable for athletic footwear. The automatic mechanisms rely solely on the pressure of the foot against the interior of the shoe to adjust fit. The high pressures exerted by many modern sports would make this style of shoe unstable. Furthermore, the manual adjustments often require mechanical devices within the sole that are difficult to adjust competently and add weight to the shoe. The present invention provides a system for modifying the properties of an article of footwear, including the fit of an article of footwear.

SUMMARY OF THE INVENTION

The present invention relates to a system for modifying at least one property of an article of footwear. The system includes a foot-supporting member that is removable from the footwear, the foot-supporting member including a frame portion, a first insert portion, and a restraining member. The frame portion is configured to define an aperture. The first insert portion is removably-received by the aperture and has a first physical characteristic. The first insert portion is also interchangeable with a second insert portion that has a second physical characteristic such that differences in the physical characteristics modify the variable property depending upon which insert portion is received by the aperture. The restraining member is attached to at least a portion of a surface of the frame portion and extends over the aperture to restrain movement of the insert portions.

The various properties of the footwear that may be modified through the present invention include the width of the footwear, the length of the footwear, the arch configuration within the footwear, and the compliance of the sole, for example. Two individuals may have comparable shoe sizes when measured with conventional foot measurement systems, but the individuals may also require footwear that provides different fit characteristics. Using the system of the present invention, a single article of footwear may be adjusted to fit individuals with feet that have different dimensions.

The present invention may be utilized to modify a variety of footwear properties, as discussed above. With respect to width, for example, the first insert portion may be removed from the aperture in the frame portion and the second insert portion may then be inserted. If the second insert portion has a greater width than the first insert portion, attachment of the second insert portion will cause the foot-supporting member to have a greater width. The foot-supporting member may then be inserted into the upper, thereby configuring the shoe for a person with a wider foot. Use of the second insert portion, therefore, configures the footwear for a person with a wider foot.

To enhance comfort and provide surface continuity, the foot-engaging surface of the foot-supporting member is attached to a stretchable restraining member. The restraining member is a single piece of material that covers the foot-supporting surface of the insert portions but does not attach to the insert portions. When the insert portions are removed, the recess in the frame portion is covered by the restraining member. In this manner, the insert portions may be removed and replaced without hindrance of the attached restraining member. The restraining member also serves to restrain movement of the insert portions. Without the restraining member, the insert portions may have a tendency to separate slightly from the frame portion when the foot-supporting member is flexed. The restraining member restrains the movement of the insert portion during flexing, thereby preventing the discomfort that may occur when the insert section repetitively protrudes into the sole. The upper or sole effectively acts to prevent the insert portions from protruding downward. Accordingly, the restraining member and the upper or sole act to secure the position of the insert portions in relation to the frame portion.

The advantages and features of novelty that characterize the present invention are pointed out with particularity in the appended claims. To gain an improved understanding of the advantages and features of novelty that characterize the present invention, however, reference may be made to the descriptive matter and accompanying drawings that describe and illustrate various embodiments of the invention.

DETAILED DESCRIPTION OF THE INVENTION

Figure 1:
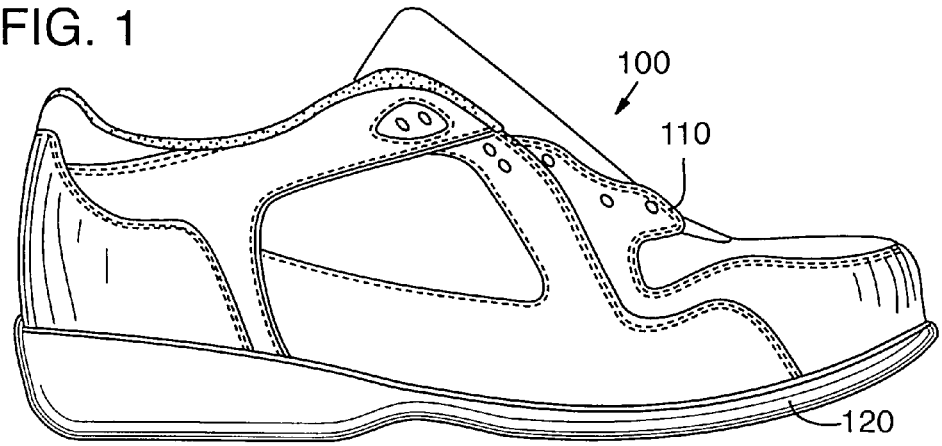
FIG. 1 is an elevational view of an article of footwear in accordance with the present invention.
Figure 2:
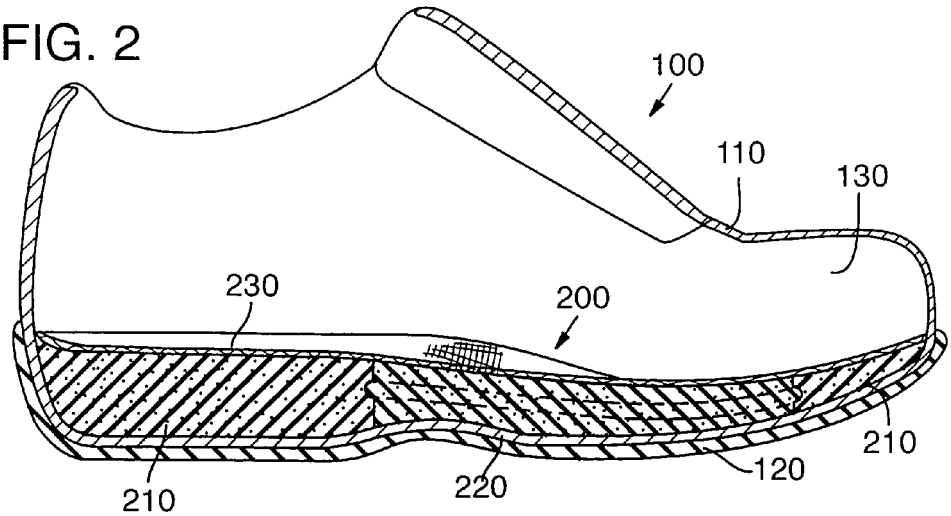
FIG. 2 is a cross-sectional view of the footwear depicted in FIG. 1.
Figure 3A:
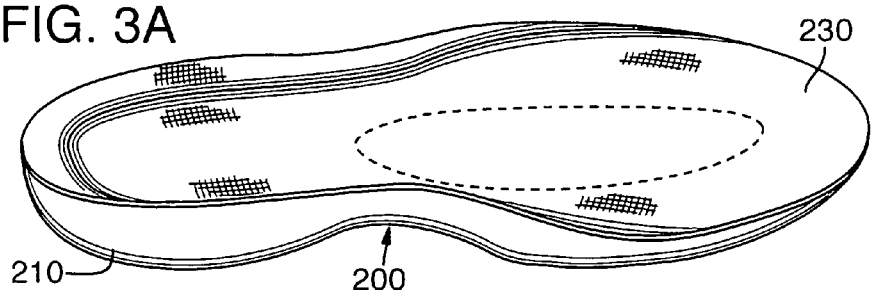
FIG. 3A is a perspective view of the top and medial side of a foot-supporting member of the footwear depicted in FIG. 2.
Figure 3B:
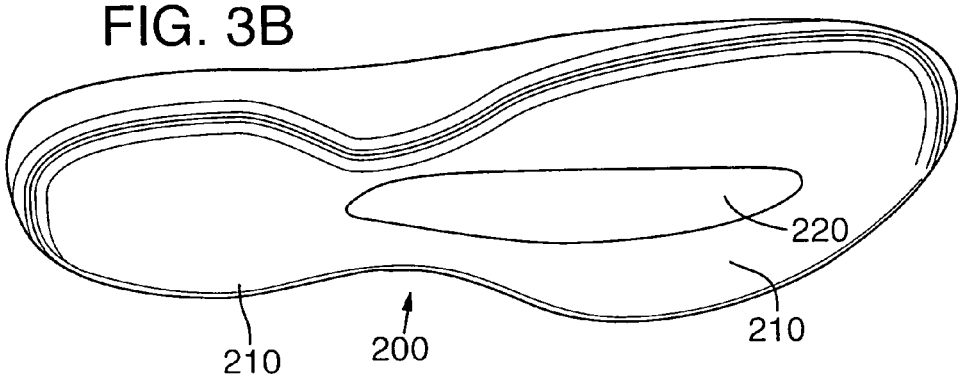
FIG. 3B is a perspective view of the bottom and medial side of the foot-supporting member depicted in FIG. 3A.
Figure 3C:
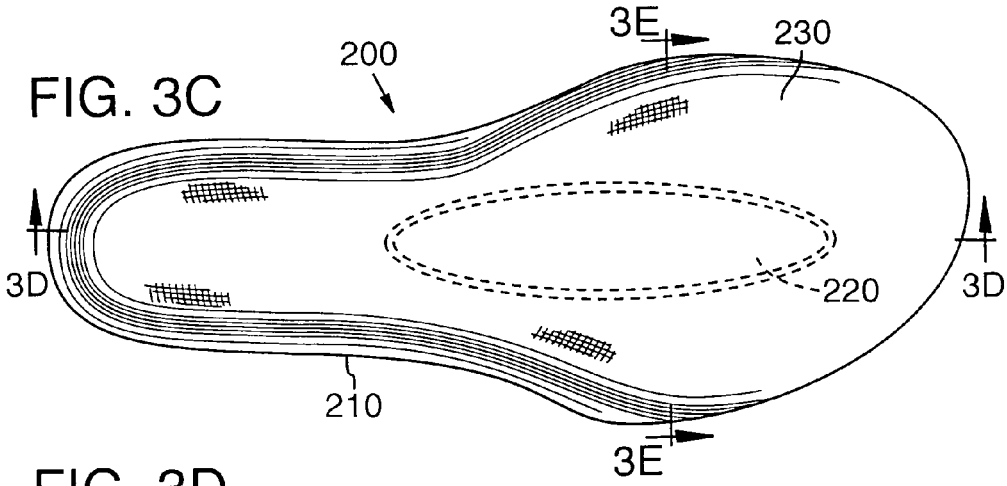
FIG. 3C is a top plan view of the foot-supporting member depicted in FIG. 3A.
Figure 3D:
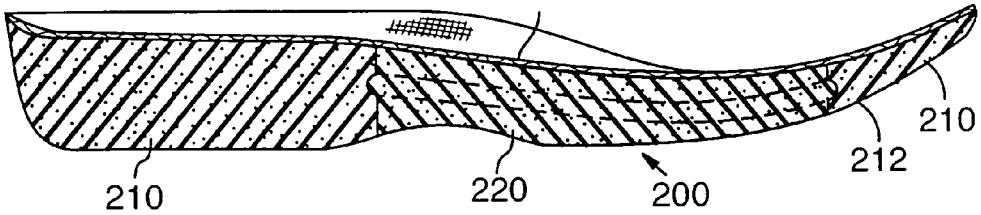
FIG. 3D is a cross-sectional view, as defined by line 3D—3D in FIG. 3C.
Figure 3E:
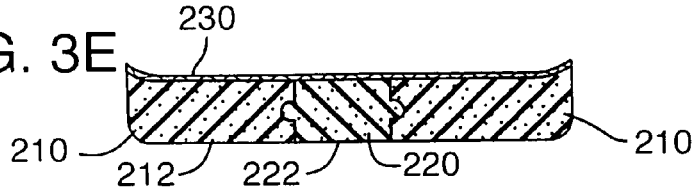
FIG. 3E is a cross-sectional view, as defined by line 3E—3E in FIG. 3C.
Figure 4A:
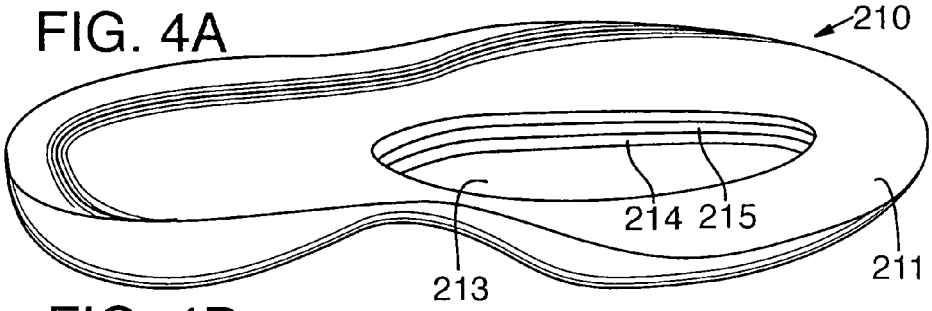
FIG. 4A is a perspective view of the top and medial side of a frame portion of the foot-supporting member depicted in FIGS. 3.
Figure 4B:
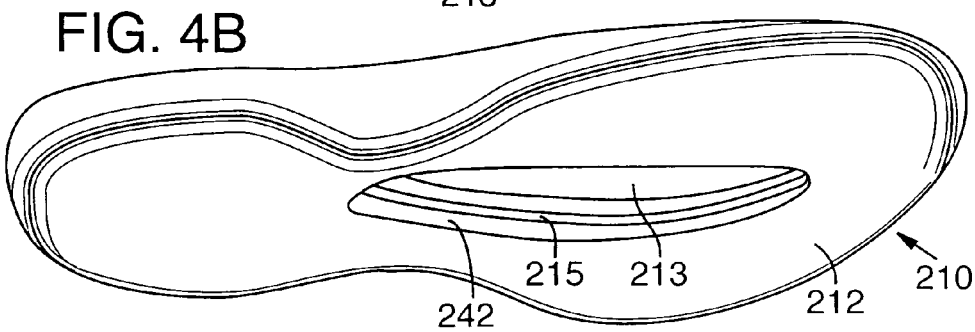
FIG. 4B is a perspective view of the bottom and medial side of the frame portion depicted in FIG. 4A.
Figures 4C, 4D, 4E:
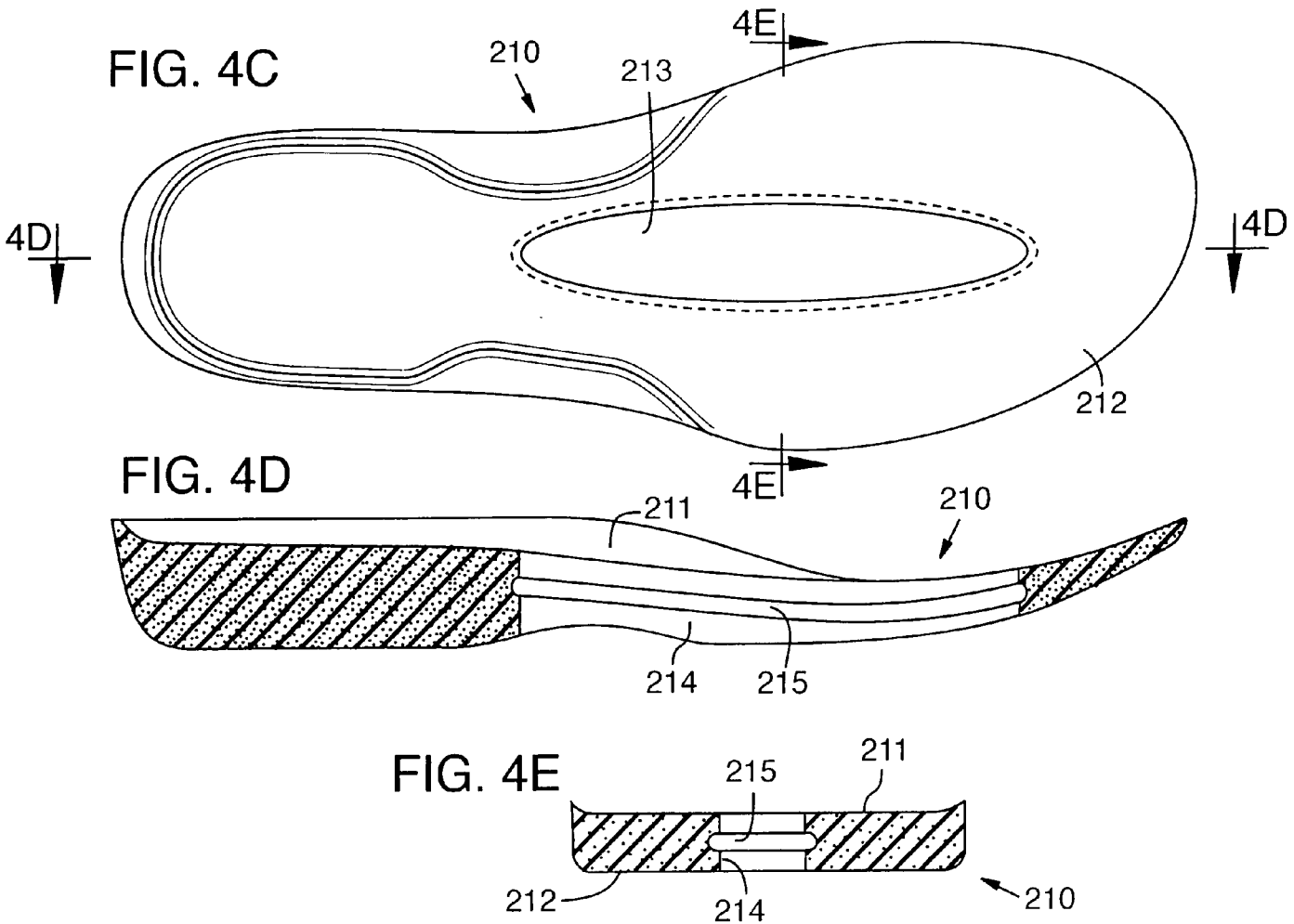
FIG. 4C is a bottom plan view of the frame depicted in FIG. 4A.
FIG. 4D is a cross-sectional view, as defined by line 4D—4D in FIG. 4C.
FIG. 4E is a cross-sectional view, as defined by line 4E—4E in FIG. 4C.

Referring to the figures and following discussion, wherein like numerals indicate like elements, a system for modifying properties of an article of footwear is disclosed. In general the system involves a foot-supporting member with at least one removable insert portion that may be interchanged with another insert portion to modify a property of the footwear, including width, length, arch support, or compliance, for example. The following discussion and accompanying figures disclose various embodiments of the invention, including an article of athletic footwear 100 and a sandal 700. One skilled in the relevant art will appreciate that the concepts disclosed with respect to footwear 100 and sandal 700 may be applied to a variety of footwear styles, including dress shoes, boots, or in-line skates. The concepts disclosed herein are not limited, therefore, to the precise embodiments disclosed, but may be applied to a wide variety of footwear styles.

Footwear 100 is depicted in FIGS. 1–11 and includes three primary components: an upper 110, a sole 120, and a removable foot-supporting member 200. Upper 110 comfortably receives the foot and forms a void 130 for receiving both the foot and foot-supporting member 200. Sole 120 is attached to a lower portion of upper 110 and provides a durable ground-contacting surface. Foot-supporting member 200 provides shock attenuation and energy absorption for the foot when footwear 100 contacts the ground during activities such as walking and running.

In forming footwear 100, a slip-lasting technique may be utilized wherein upper 110 is formed around a last and sole 120 is attached to the underside of upper 110. Following removal of the last from upper 110, thereby creating a void 130, foot-supporting member 200 is inserted into a portion of void 130 located adjacent to sole 120. The remaining volume of void 130 is reserved for the foot.

Modern athletic footwear conventionally includes an upper and a sole structure. The sole structure has a multilayer construction that includes an outsole, midsole, and insole. The outsole forms a durable ground-engaging region that resists wear and may incorporate a textured surface for providing traction. The midsole forms a middle layer of the sole structure and may incorporate a resilient foam material that attenuates shock and absorbs energy from the ground reaction forces that occur as a result of running, walking, or other movements. The insole is a thin padded member located adjacent the foot that enhances comfort. In contrast to conventional articles of athletic footwear, as described above, footwear 100 does not incorporate a conventional sole structure. Instead, a portion of the sole structure is replaced by foot-supporting member 200.

Foot-supporting member 200, depicted in FIGS. 3, includes a frame portion 210, an insert portion 220, and a restraining member 230. Frame portion 210, depicted in FIGS. 4, may be formed of the types of foam conventionally utilized in midsoles of athletic footwear, including polyurethane foam or ethylvinylacetate foam, for example. Suitable polyurethane foams may have a hardness in the range of 20–76 on the Asker C scale and a density between 0.25 and 0.45 grams per centimeter cubed. Similarly, ethylvinylacetate foam may have a hardness in the range of 24–70 on the Asker C scale and a density between 0.12 and 0.34 grams per centimeter cubed. In some embodiments an alternate material could be utilized to provide different cushioning or conforming properties. Frame portion 210 includes an upper surface 211 and an opposite lower surface 212. Upper surface 211 may be contoured to conform to the lower surface of the foot, whereas lower surface 212 generally conforms to the shape of the interior surface of upper 110 that is located adjacent to sole 120. If the slip-lasting technique described above is utilized to manufacture footwear 100, lower surface 212 may have the shape of the lower surface of the last, thereby conforming to the shape of void 130 in the area where foot-supporting member 200 is positioned.

Aperture 213 forms an elliptically-shaped opening through frame portion 210 that extends along the center of a forward portion of foot-supporting member 200. More particularly, aperture 213 is centrally-located and extends from the arch area into the metatarsal area. In further embodiments, however, aperture 213 may have alternate shapes and may be located in other portions of foot-supporting member 200. Aperture wall 214 defines aperture 213 and extends between foot-engaging surface 212 and lower surface 212.

One of a plurality of insert portions 220, depicted in FIG. 5, may be removably-received by aperture 213. Each insert portion 220 includes an upper surface 221 and an opposite lower surface 222 that align with upper surface 211 and lower surface 212, respectively, of frame portion 210. Like frame portion 210, insert portions 220 may be formed of polyurethane foam or an ethylvinylacetate foam, for example. To ensure that the properties and feel of insert portions 220 match that of frame portion 210, both may be formed from the same material. Each insert portion 220 also includes a side wall 224 that extends between upper surface 221 and lower surface 222. When one of insert portions 220 is properly located within aperture 213, side wall 224 is positioned adjacent to and in contact with aperture wall 214. In order to provide a continuous surface for supporting the foot, upper surface 221 is generally flush with upper surface 211. In addition, lower surface 222 may be flush with lower surface 212.

Figure 5A:
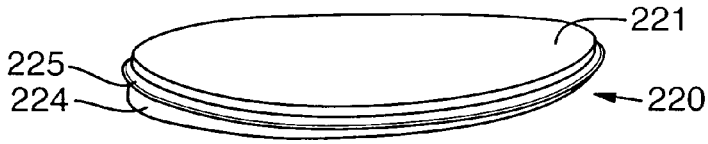
FIG. 5A is a perspective view of the top and medial side of an insert portion of the foot-supporting member depicted in FIGS. 3.
Figure 5B:
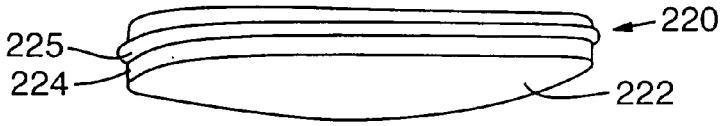
FIG. 5B is a perspective view of the bottom and medial side of the insert portion depicted in FIG. 5A.
Figure 5C:
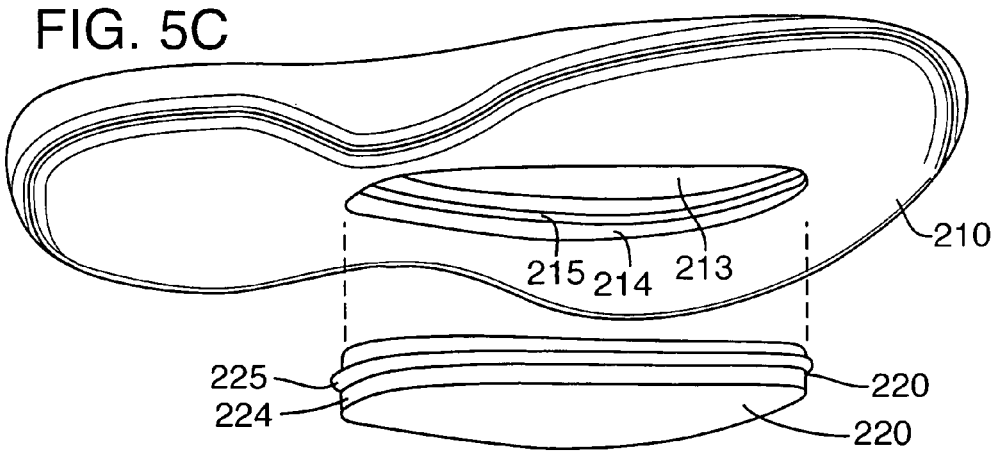
FIG. 5C is a perspective view showing the relationship between a frame portion and an insert portion.
Figure 5D:
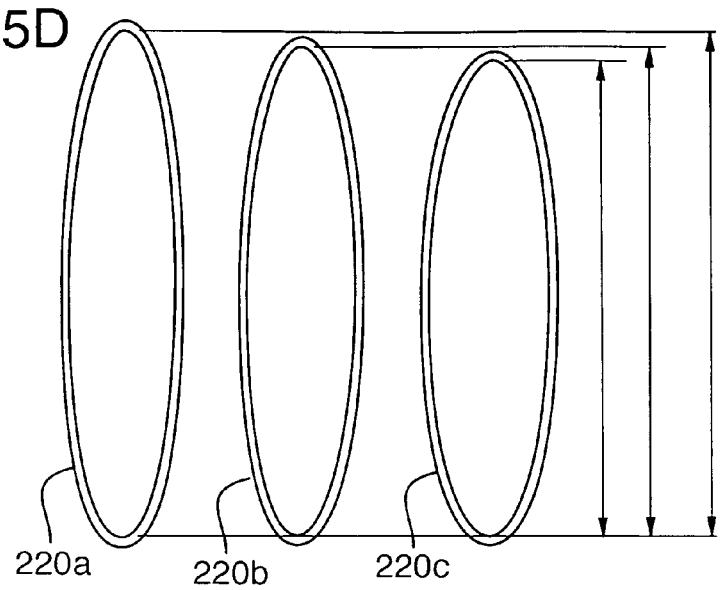
FIG. 5D is a top plan view of three insert portions.
Figure 5E:
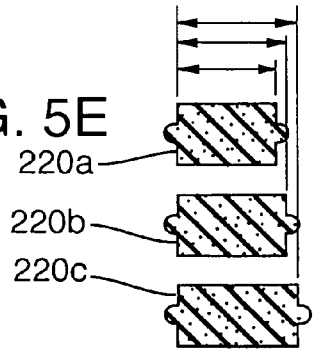
FIG. 5E is a cross-sectional view of the insert sections depicted in FIG. 5D.

FIGS. 5D and 5E depict three insert portions 220*a,* 220*b,* and 220*c*. The use of three insert portions 220 in the following discussion is for illustrative purposes only as the present invention may include any number of insert portions 220. The primary difference between insert portions 220*a,* 220*b,* and 220*c,* all being elliptically-shaped, lies in their relative eccentricity. Insert portion 220*a* has a greater eccentricity than insert portion 220*b,* and insert portion 220*b* has a greater eccentricity than insert portion 220*c*. Accordingly, the length of insert portion 220*a* is greater than the length of insert portion 220*b,* and each has a greater length than the length of insert portion 220*c*. Similarly, the width of insert portion 220*a* is less than the width of insert portion 220*b,* and each has a lesser width than the width of insert portion 220*c*.

Insert portions 220 are designed to be removably-received by aperture 213. Since frame portion 210 may be formed from a compliant material, the distance around the perimeter of aperture 213 increases slightly with the application of relatively low stresses. Despite the compliance of the material that forms frame portion 210, the length of aperture 213 decreases only slightly as the width of aperture 213 is increased by the application of forces. Accordingly, the dimensions of the various insert portions 220 are selected such that each insert portion 220 accurately fits within aperture 213.

The primary purpose of insert portions 220, in conjunction with frame portion 210, is to facilitate a width adjustment of footwear 100. When insert portion 220*b* is received by aperture 213 of frame portion 210, the dimensions of foot-supporting member 200 correspond with the dimensions of the statistically-average foot for the selected shoe size. By placing foot-supporting member 200 into upper 110, shoe 100 is configured for a wearer having a foot with statistically-average characteristics. By replacing insert portion 220*b* with insert portion 220*a,* which has greater length and lesser width, footwear 100 is configured for a wearer with a foot that is more narrow than average. Similarly, use of insert portion 220*c* configures footwear 100 for a foot having wider than average dimensions.

Various sizes of foot-supporting member 200 may be manufactured to accommodate a variety of foot sizes. Foot-supporting member 200 may, therefore, be manufactured to accommodate a foot having dimensions that correspond with a women's size U.S. 7. Insert portion 220 may then have a width of 22 millimeters and a length of 120 millimeters, for example, to configure footwear 100 for a B width. Similarly, insert portion 220 may have a width of 29.5 millimeters and a length of 118.5 millimeters to configure footwear 100 for a D width, and insert portion 220 may have a width of 37 millimeters and a length of 117 millimeters to configure footwear 100 for a EE width.

With regard to the dimensions of insert portions 220 discussed above, relatively large increases in width are coupled with relatively small decreases in length. An elliptically-shaped insert portion 220 may be utilized, therefore, to facilitate a width adjustment without significantly affecting the length of foot-supporting member 200.

In designing foot-supporting member 200, one skilled in the art will recognize that the degree of warping occurring as a result of inserting an individual insert portion 220 is inversely proportional to thickness of frame portion 210. Accordingly, foot-supporting member 200 may be designed to have a thickness that resists significant warping and provides sufficient comfort and shock absorption. As depicted, the thickness of frame portion 210 ranges from approximately ⅜ of an inch in fore portions of aperture 213 to ¾ of an inch in aft portions of aperture 213. A greater or lesser thickness, however, may be used.

A foot that has statistically-average proportions is an infrequent occurrence. More specifically, a foot with proportions that fit perfectly into an article of footwear formed on a last that is designed for the statistically-average foot is an infrequent occurrence. Accordingly, the majority of individuals have the potential to benefit from the ability to adjust fit using the system of the present invention. For example, many individuals have used footwear designed for statistically-average proportions with relatively good comfort and relatively proper fit. However, the ability to alter footwear dimensions provides these individuals with the ability to increase comfort and fit by making minute adjustments. Whereas the dimensions of insert portions 220*a*, 220*b*, and 220*c* may vary significantly so as to accommodate individuals with narrow or wide feet, insert portions 220 with small dimensional differences may be utilized to facilitate a minute degree of footwear adjustment.

A further benefit of this adjustment system lies in the ability of the wearer to fit footwear to an individual foot rather than to both feet simultaneously. A particular size of footwear, based on foot length, typically accommodates both feet of a wearer, but both feet may not have identical proportions. Accordingly, the wearer may utilize differing insert portions 220 in the left and right article of footwear so as to adjust fit for the particular foot, not for the feet generally. Growth in children, medical conditions, and maternity, for example, may cause foot proportions to change during relatively short periods of time. The present invention may also be utilized to modify the dimensions of footwear 100 to accommodate changing foot proportions.

Restraining member 230 may be attached to substantially all of upper surface 211, or at least a portion of upper surface 211, and extends over aperture 213, but does not attach to upper surface 221 of insert portions 220. This configuration permits insert portions 220 to be removed and replaced from the lower portion of aperture 213. Restraining member 230 may be formed from a plurality of materials that include textiles and polymer sheets for example. In order to accommodate insert portions 220 that have differing dimensions, restraining member 230 may be formed from a material that stretches and contracts, including elastomeric textiles, neoprene, or 2-way stretch duraplush textiles, for example. In alternate embodiments of footwear 100, restraining member 230 may be attached to lower surface 210, thereby allowing insert portions 220 to be inserted from an upper portion of aperture 213.

The advantages gained through use of restraining member 230 include a continuous upper surface to foot-supporting member 200 and a more secure connection between frame portion 210 and insert portions 220. By extending restraining member 230 across foot-engaging surface 210 and aperture 213, the seam formed by the junction between insert portion 220 and frame portion 210 will be less noticeable to the wearer. In addition, the continuous nature of restraining member 230 decreases the likelihood that debris which enters the footwear 100 will become lodged in the junction, thereby causing discomfort to the wearer. Flexing of foot-supporting member 200 generates forces that may cause insert portion 220 to move independently of frame portion 210. Independent movement is effectively restrained by portions of upper 110 that are adjacent to sole 120 and by the foot. However, if the foot is not in close contact with insert portion 220, restraining member 230 serves to effectively restrain independent movement.

The stretch properties of restraining member 230 also contribute to restraining independent movement of insert portion 220. When joining insert portion 220 with frame portion 210, restraining member 230 stretches so as to permit aperture 213 to have the appropriate width. When insert portion 220 is positioned within aperture 213, restraining member 230 remains under tension, thereby exerting an inwardly-directed force on insert portion 220. The inwardly-directed force compresses aperture wall 214 against side wall 224, thereby securing insert portion 220 into position. As will be discussed in greater detail below, insert portions 220 may have purposes other than width adjustment. Depending upon the specific purpose for insert portions 220, restraining member 230 may be formed of a non-stretch material.

Figure 6:
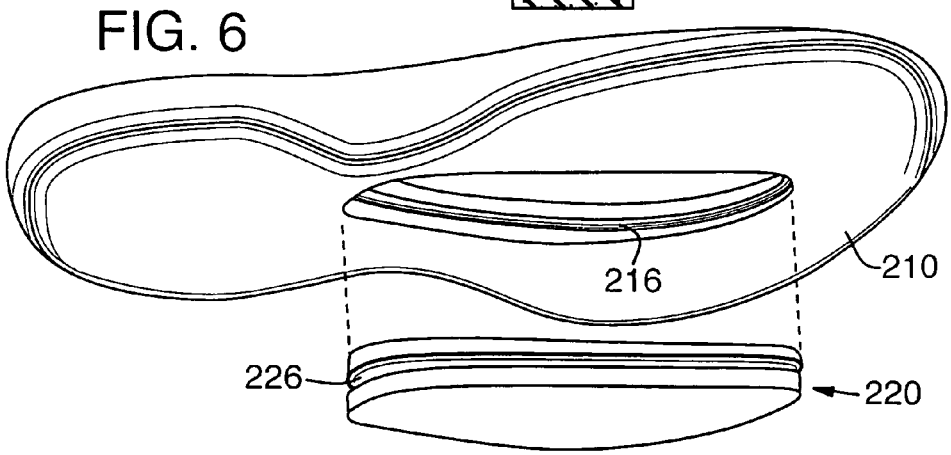
FIG. 6 is a perspective view of an alternate embodiment of the present invention.
Figure 7A:
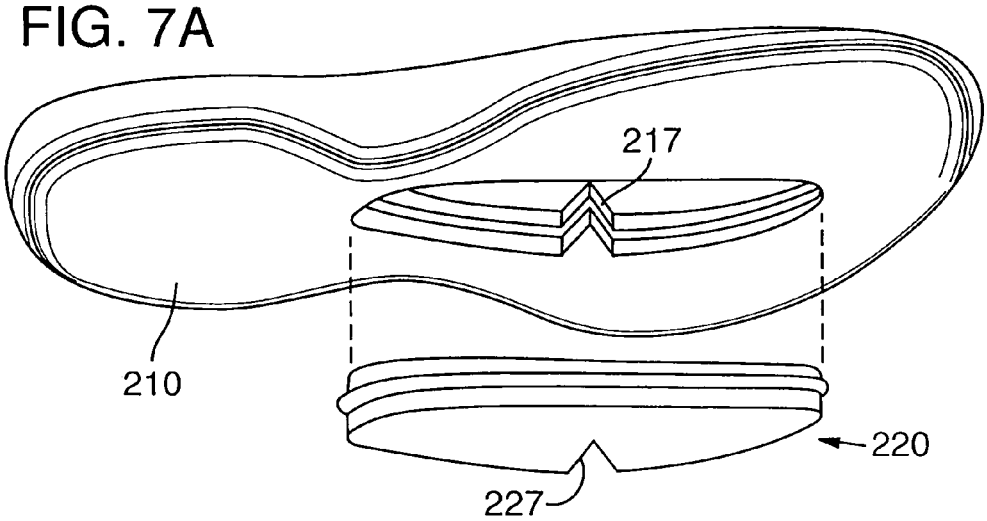
FIG. 7A is a perspective view showing the relationship between a frame portion and an insert portion of an alternate embodiment of the present invention.
Figure 7B:
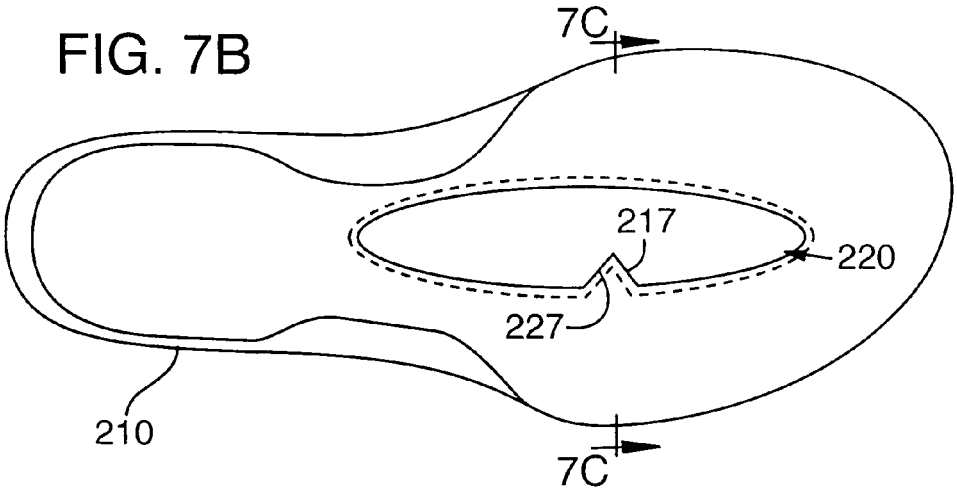
FIG. 7B is a bottom plan view of the embodiment depicted in FIG. 7A.
Figure 7C:
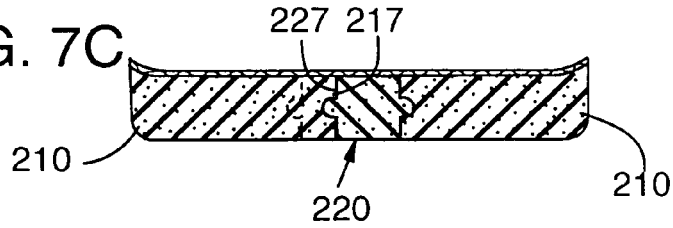
FIG. 7C is a cross-sectional view, as defined by line 7C—7C in FIG. 7B.

A further feature of the present system that ensures a secure connection between frame portion 210 and insert portions 220 resides in a depression 215 and a ridge 225. Depression 215 circumscribes aperture wall 214 and is located approximately one-half of the distance between upper surface 211 and lower surface 212 of frame portion 210. Ridge 225 is located in a corresponding position on side wall 224 of insert portion 220. When insert portion 220 is properly joined with frame portion 210, ridge 225 is located within depression 215. In an alternate embodiment, the configuration of depression 215 and ridge 225 may be reversed such that insert portion 220 includes a depression 226 and frame portion 210 includes a ridge 216, as depicted in FIG. 6. One skilled in the relevant art will appreciate that a variety of alternate attachment systems may be utilized to secure insert portion 220 within aperture 213, including a hook and loop fastening system, magnets, zippers, or tacky substances applied to one or both of aperture wall 214 and side wall 224.

Although insert portions 220 are elliptically-shaped, the thickness, as measured between foot-engaging surface 221 and lower surface 222 may vary along the length of individual insert portions 220. Accordingly, it is important that the wearer correctly orient insert portions 220 prior to joining an individual insert portion 220 with frame portion 210. In an alternate embodiment of the present invention, depicted in FIG. 7, the uniform elliptical shape of insert portion 220 may be broken by an indentation 227 in side wall 224 that extends from upper surface 221 to lower surface 222. Aperture wall 214 of frame portion 210 may include an identically-shaped protrusion 217 in a corresponding position. If the wearer attempts to orient insert portion 220 incorrectly, protrusion 217 and indentation 227 do not align, thereby warning the wearer of the incorrect orientation.

The above disclosure relates to an elliptically-shaped aperture 213 and corresponding insert portions 220. Other shapes for aperture 213 and insert portion 220 also fall within the scope of the present invention. With regard to adjustments in width or length, the shape of aperture 213 and insert portion 220 may be empirically determined by selecting a configuration wherein differences in dimensions apply different stresses to portions of frame portion 210, thereby altering specific dimensions of foot-supporting member 200. Accordingly, aperture 213 and insert portion 220 may be rectangular, triangular, circular, or any other regular, non-regular, geometric, or non-geometric shape, for example.

A system for modifying the width of an article of footwear is disclosed above with reference to interchanging various insert portions 220. In an alternate embodiment, aperture 213 may have the configuration of a slit in frame portion 210 such that the sides of aperture 213 make contact when no insert portion 220 is located within aperture 213. Accordingly, footwear 100 will have a first width when no insert portion 220 is located within aperture 213. The width of footwear 100 may be altered by separating the sides of aperture 213 and introducing an insert portion 220. The present invention, therefore, is not limited to width adjustments by interchanging insert portion 220, and may be modified to permit width adjustments by merely introducing an insert portion 220. A similar system for length adjustment is disclosed below with respect to foot-supporting member 300.

The above discussion refers primarily to a system for modifying the width of an article of footwear. The concepts in the discussion, however, may be applied to a variety of footwear properties, such as length, arch support, or the compliance of specific portions of foot-supporting member 200. Systems that alter these properties are disclosed in the following discussion.

Figure 8A:
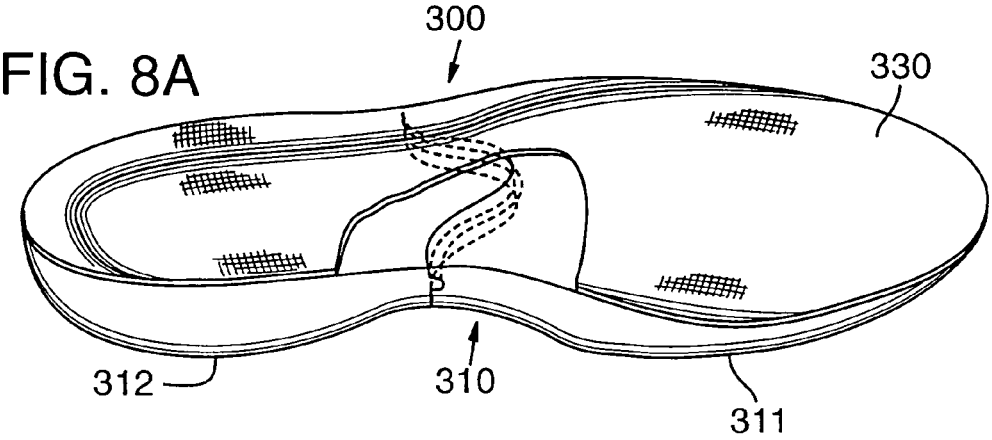
FIG. 8A is a perspective view of a frame portion that is modifiable with respect to length, with a portion of a restraining member cut-away.
Figure 8B:
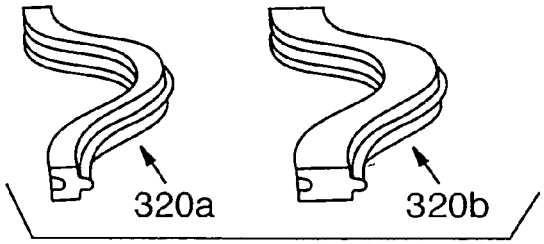
FIG. 8B is a perspective view of two insert portions.
Figure 8C:
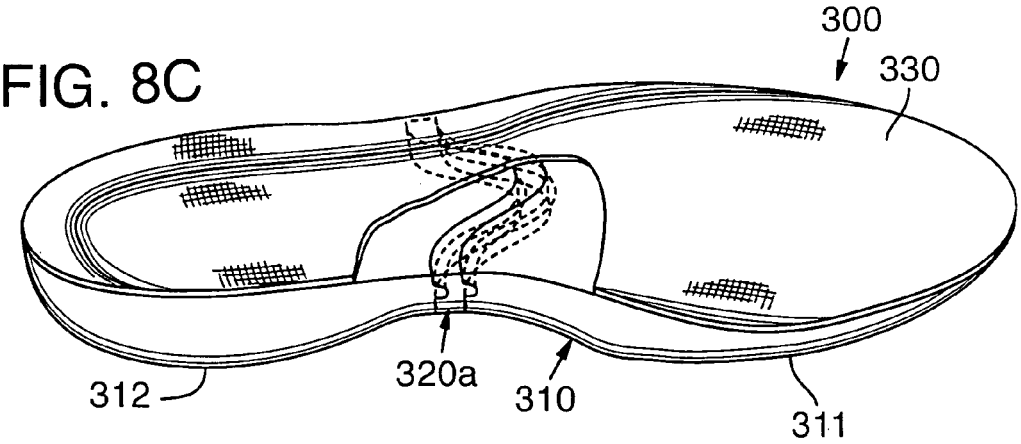
FIG. 8C is a perspective view of a foot-supporting member that includes the frame portion of FIG. 8A and the insert portion of FIG. 8B.

A foot-supporting member 300 that may replace foot-supporting member 200 and is modifiable with respect to length is depicted in FIG. 8. Foot-supporting member 300 includes a frame portion 310 having a fore section 311 and an aft section 312 that are separable. A restraining member 330 is attached to the upper surfaces of frame portion 310. When configured for a foot having a relatively short length, fore section 311 and aft section 312 are in an adjacent and abutting relationship, as depicted in FIG. 8A. In order to increase the length of foot-supporting member 300, one of a plurality of insert portions 320, which are depicted in FIG. 8B, may be disposed between fore section 311 and aft section 312, as depicted in FIG. 8C. The various insert portions 320 may have differing dimensions, specifically in the direction corresponding with the length of foot-supporting member 300, to configure foot-supporting member 300 for a variety of lengths. Restraining member 330 may be a stretchable material that accommodates separating fore section 311 and aft section 312 to provide an aperture for receiving the various insert portions 320.

Figure 9A:
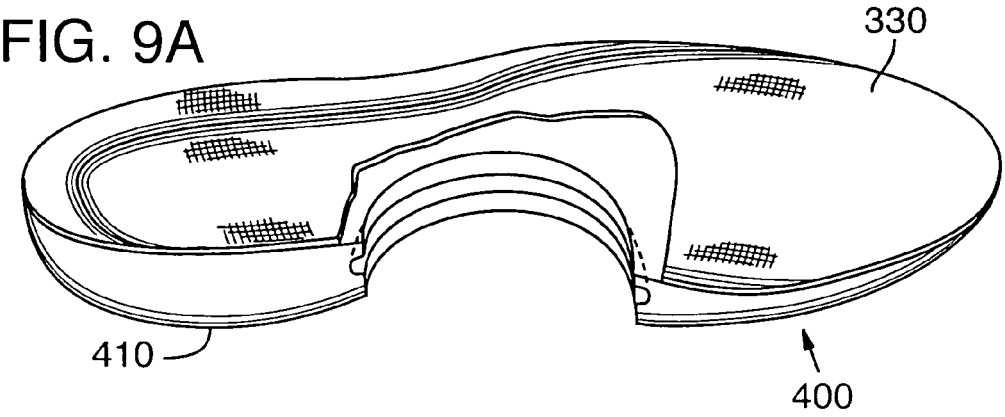
FIG. 9A is a perspective view of a frame portion that is modifiable with respect to arch configuration, with a portion of a restraining member cut-away.
Figure 9B:
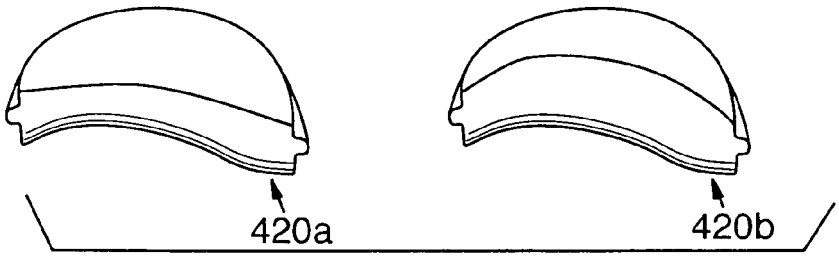
FIG. 9B is a perspective view of two insert portions.
Figure 9C:
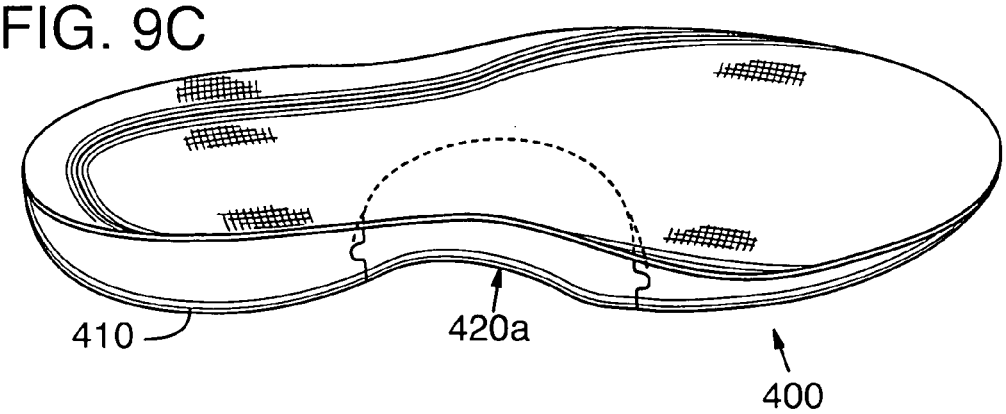
FIG. 9C is a perspective view of a foot-supporting member that includes the frame portion of FIG. 9A and an insert portion of FIG. 9B.

A foot-supporting member 400 that is modifiable with respect to the arch configuration is depicted in FIG. 9. Many individuals would benefit from greater or lesser support in the arch area of the foot. Individuals with a high arch, for example, may benefit from a pronounced arch support within the footwear. Similarly, individuals with a flat arch may prefer little or no arch support within the footwear. Foot-supporting member 400 includes a frame portion 410, a variety of insert portions 420, and a restraining member 430. Frame portion 410, depicted in FIG. 9A, includes an aperture in the area of foot-supporting member 400 that corresponds with the arch of a foot. One of the insert portions 420, which are depicted in FIG. 9B and have varying thicknesses and contours, may be positioned within the aperture to provide various degrees of arch support, as depicted in FIG. 9C.

Figure 10A:
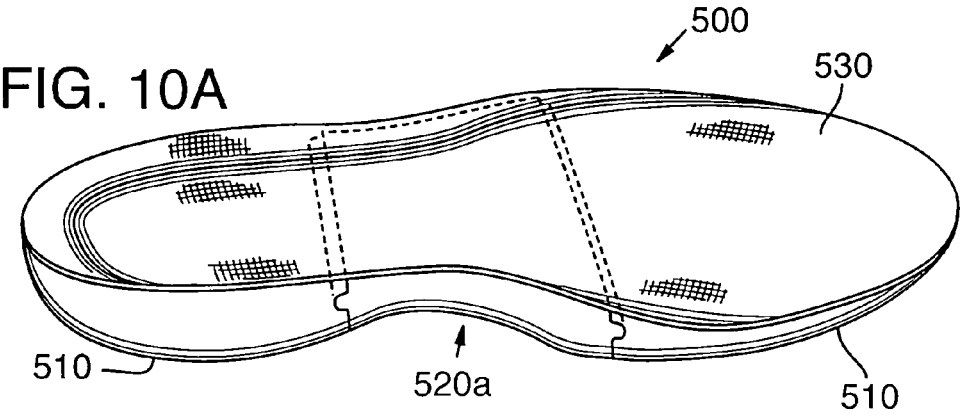
FIG. 10A is a perspective view of a foot-supporting member that is modifiable with respect to both length and arch configuration.
Figure 10B:
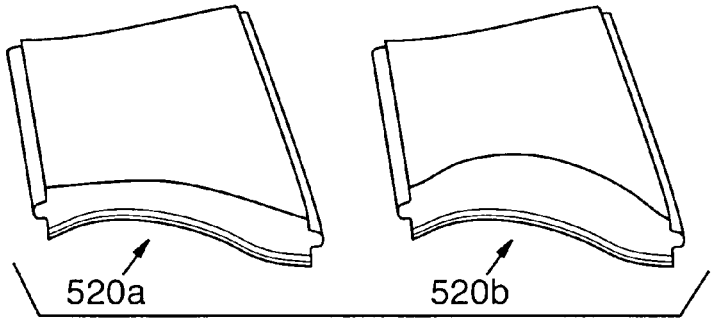
FIG. 10B is a perspective view of an insert portion of the foot-supporting member depicted in FIG. 10A, and an alternate insert portion.

A foot-supporting member 500 that is modifiable with respect to both length and arch configuration is depicted in FIG. 10. Foot-supporting member 500 includes a frame portion 510, an insert portion 520, and a restraining member 530. Each insert portion 529 may be dimensioned to alter a length of foot-supporting member 500 and provide a different arch height. Accordingly, the plurality of insert portions 520, as depicted in FIG. 10B may provide the wearer with any combination of length and arch height adjustment.

Figure 11A:
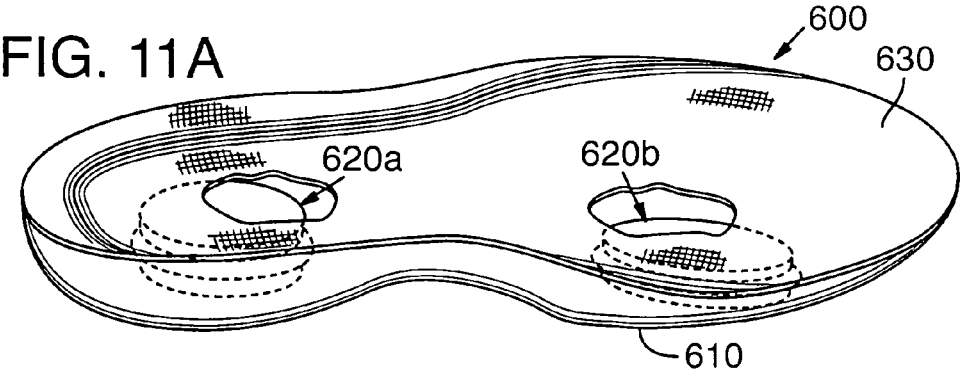
FIG. 11A is a perspective view of a foot-supporting member that is modifiable with respect to compliance, with portions of the restraining member cut-away.
Figure 11B:
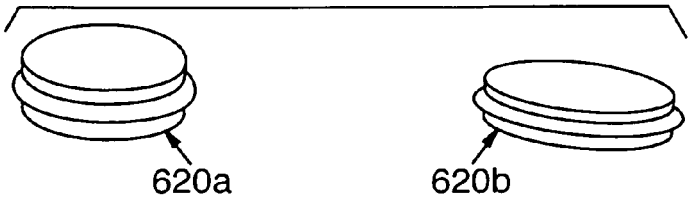
FIG. 11B is a perspective view of two insert portions of the foot-supporting member depicted in FIG. 11A.

In addition to geometry changes, the present invention may be utilized to change the cushioning properties of footwear 100. A foot-supporting member 600 that includes a frame portion 610, an insert portion 620*a*, an insert portion 630*b*, and a restraining member 630 are depicted in FIG. 11. Insert portion 620*a* may be inserted into an aperture in the heel portion of frame portion 610 and interchanged with another insert portion 620*a*. Each insert portion 620*a* may be formed of a material having different degrees of compliance. Accordingly, an individual may configure foot-supporting member 600 to have a soft or hard heel area. In addition, each insert portion 620*a* may have either a flat or curved upper surface to provide differing types of support for the heel. A curved upper surface, for example, may be beneficial for an individual with bone spurs, for example. Similarly, insert portion 620*b* may interchanged with another insert portion 620*b* to alter the compliance of the area underlying the head of the first metatarsal. When the area underlying the first metatarsal head has greater compliance then surrounding portions of the upper surface, the first metatarsal head may plantarflex, thereby facilitating the natural motion of the foot.

The various foot-supporting members 200, 300, 400, 500, and 600 provide examples of various systems by which the properties of footwear 100 may be modified. In general, each foot-supporting member includes a frame portion, an insert portion and a restraining member that extends over an aperture formed in the frame portion. The restraining member provides advantages, including a continuous upper surface for each foot-supporting member and a more secure connection between the frame portion and the insert portions. The restraining member, therefore, effectively decreases the noticeability of the seam formed at the junction of the frame portion and the insert portion. In addition, the restraining member restrains the insert portion from moving independently with respect to the frame portion. The sole restrains movement of the insert portion on the side opposite the restraining member.

Figure 12A:
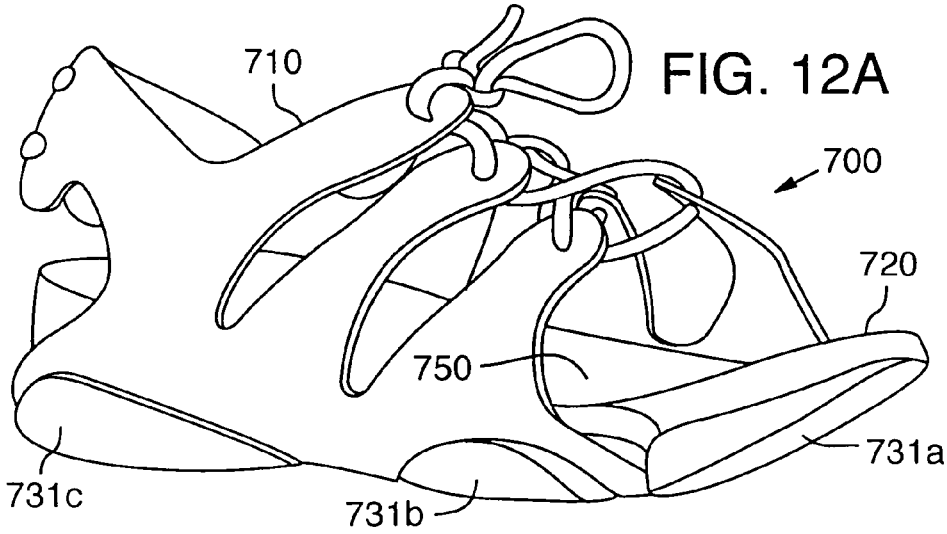
FIG. 12A is a perspective view of a sandal having a foot-supporting member in accordance with the present invention.
Figure 12B:
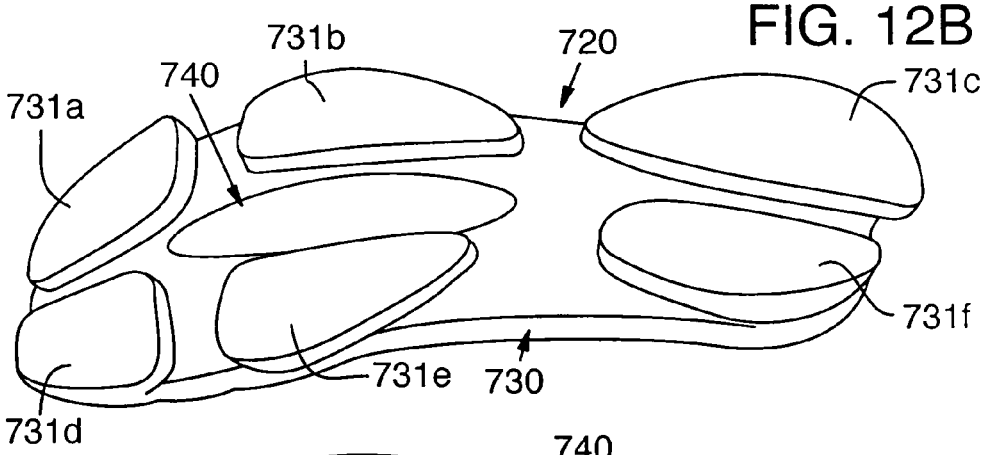
FIG. 12B is a bottom perspective view of the foot-supporting member for the sandal depicted in FIG. 12A.
Figure 12C:
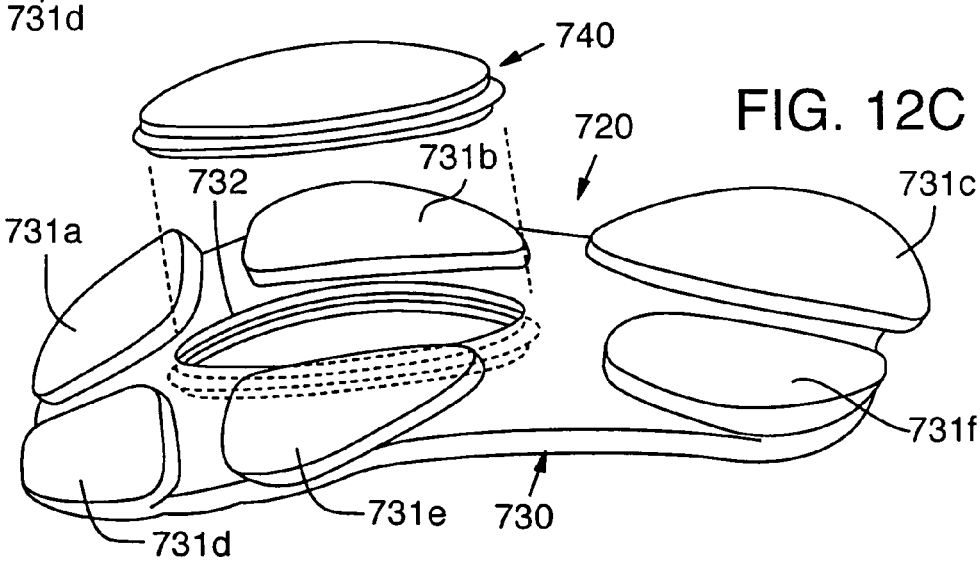
FIG. 12C is a bottom perspective view of the foot-supporting member for the sandal depicted in FIG. 12A that demonstrates the relationship between a frame portion and an insert portion.

The embodiments discussed above relate to an article of footwear 100 that is an athletic shoe. FIG. 12 depict a sandal 700 having an upper 710 that wraps around and connects to a foot-supporting member 720. Foot-supporting member 720 includes a frame portion 730, an insert portion 740, and a restraining member 750. Upper 710 is configured to wrap around foot-supporting member 720 such that a plurality of protrusions 731 formed in foot-supporting member 720 protrude through upper 710. Protrusions 731 are traction elements that are formed integral with frame portion 730 and provide a ground contacting surface for sandal 700. Frame portion 730 also includes an aperture 732 that receives insert portion 740. As depicted in FIG. 12, foot-supporting member 720 is configured to have adjustable width and the width may be altered by interchanging insert portion 740 with an insert portion 740 having different dimensions. Accordingly, the considerations discussed above with respect to foot-supporting member 200 are applicable to foot-supporting member 720. Foot-supporting member 720 may, however, be configured to have modifiable length, arch support, or cushioning properties, for example.

As with prior embodiments, restraining member 750 provides advantages that include a continuous surface, a secure connection between frame portion 730 and insert portion 740, and a positive tension across the surface. In the prior embodiments, however, the insert portions were restrained from downward movement by a portion of the upper and sole structure located under the foot-supporting member. With regard to sandal 700, downward movement of insert portion 740 is restrained by the portion of upper 710 alone that is located adjacent to the lower surface of foot-supporting member 720.

Restraining member 750 serves two primary purposes. First, restraining member 750 provides a continuous foot-engaging surface that promotes the comfort of sandal 700. Second, restraining member 750 prevents significant upward movement of insert portion 740. An individual may find that removing upper 710 to replace insert portion 740 is inconvenient in certain situations. In addition, upper 710 may be permanently attached to the frame portion of foot-supporting member 720. Accordingly, the ability to remove insert portion 740 from the foot-engaging surface may be beneficial. In an alternate embodiment, therefore, upper 710 may serve as a restraining member that prevents downward movement of insert portion 740. To ensure that the seam between insert portion 740 and the frame portion remain comfortable a plush fabric with significant nap may be utilized to cover the foot-engaging surface. Alternately, restraining member 750 may be located on a lower surface of foot-supporting member 720 to inhibit downward movement of insert portion 740.

In footwear 100, sole 120 and foot-supporting member 200 were two separate components. In sandal 700, however, foot-supporting member 720 also includes sole portions 731. Accordingly, the concepts disclosed in the present invention may also be applied to footwear configurations wherein the foot-supporting member and the sole are a single, integral component.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

That which is claimed is:

1. A system for modifying at least one variable property of an article of footwear, said system comprising a foot-supporting member and an insert portion, said foot-supporting member being removable from a void within said footwear, and said foot-supporting member having a frame portion that defines an aperture for removably-receiving said insert portion, a property of said footwear being modified by inserting said insert portion into said aperture, and said foot-supporting member including a restraining member that is attached to at least a portion of a surface of said frame portion and unattached to a surface of said insert portion, said restraining member extending across said aperture to restrain movement of said insert portion when said insert portion is received by said aperture.

2. The system of claim 1, wherein said foot-supporting member includes a first said insert portion and a second said insert portion, said property of said footwear being modified by interchanging said first said insert portion with said second said insert portion.

3. The system of claim 1, wherein one of an upper and a sole restrain downward movement of said insert portion.

4. The system of claim 1, wherein said property is a dimension of said footwear.

5. The system of claim 4, wherein said dimension is one of a width and a length of said footwear.

6. The system of claim 1, wherein said restraining member expands and contracts to accommodate increases and decreases in dimensions of said foot-supporting member.

7. The system of claim 1, wherein said surface of said frame portion is an upper surface of said frame portion, and said surface of said insert portion is an upper surface of said insert portion.

8. The system of claim 1, wherein said foot-supporting member has a first width when said insert portion is not received by said aperture, and said foot-supporting member has a second width when said insert portion is received by said aperture, said first width being less than said second width.

9. The system of claim 1, wherein said foot-supporting member has a first length when said insert portion is not received by said aperture, and said foot-supporting member has a second length when said insert portion is received by said aperture, said first length being less than said second length.

10. A system for modifying at least one variable property of an article of footwear, said system comprising a foot-supporting member and a plurality of insert portions, said foot-supporting member being removable from a void within said footwear, and said foot-supporting member having a frame portion that defines an aperture for removably-receiving one of said insert portions, said insert portions including a first insert portion and a second insert portion with a shape that corresponds to a shape of said aperture, said first insert portion having a first physical characteristic and said second insert portion having a second physical characteristic, and said first insert portion and said second insert portion being interchangeable within said aperture, differences in said physical characteristics modifying said at least one variable property, and said foot-supporting member including a restraining member that is attached to at least a portion of a surface of said frame portion and unattached to surfaces of said insert portions, said restraining member extending across said aperture to restrain movement of said one of said plurality of said insert portions that is received by said aperture.

11. The system of claim 10, wherein said surface of said frame portion is an upper surface of said frame portion, and said surfaces of said insert portions are upper surfaces of said insert portions.

12. The system of claim 10, wherein one of an upper and a sole restrain downward movement of said one of said plurality of said insert portions that is received by said aperture.

13. The system of claim 10, wherein said at least one variable property is a dimension of said footwear.

14. The system of claim 13, wherein said first physical characteristic and said second physical characteristic are dimensions of said insert portions, said dimensions of said insert portions being different to modify said at least one dimension of said footwear.

15. The system of claim 13, wherein said dimension is one of a width and a length of said footwear.

16. The system of claim 10, wherein said first physical characteristic is a compliance of said first insert portion, and said second physical characteristic is a compliance of said second insert portion, said compliance of said first insert portion and said compliance of said second insert portion being different.

17. The system of claim 10, wherein said restraining member expands and contracts to accommodate increases and decreases in dimensions of said foot-supporting member.

18. The system of claim 10, wherein said aperture extends from an upper surface of said frame portion to a lower surface of said frame portion.

19. The system of claim 18, wherein upper surfaces of said insert portions are configured to align with said upper surface of said frame portion, and lower surfaces of said insert portions are configured to align with said lower surface of said frame portion.

20. The system of claim 10, wherein said first insert portion and said second insert portion are elliptically-shaped, said first insert portion having a greater eccentricity than said second insert portion.

21. The system of claim 20, wherein interchanging said first insert portion with said second insert portion alters a dimension of said footwear.

22. The system of claim 20, wherein said foot-supporting member has a first width when said first insert portion is received by said aperture and said foot-supporting member has a second width when said second insert portion is received by said aperture, said first width being less than said second width.

23. The system of claim 10, wherein said aperture is located within an arch area of said foot-supporting member.

24. The system of claim 23, wherein said arch area has a first height when said first insert portion is located within said aperture, and said arch area has a second height when said second insert portion is located within said arch area, said first height being less than said second height.

25. The system of claim 10, wherein said aperture is located in a mid-portion of said foot-supporting member.

26. The system of claim 25, wherein said footwear has a first length when said first insert portion is located within said aperture, and said footwear has a second length when said second insert portion is located within said aperture, said first length being less than said second length.

27. The system of claim 10, wherein said aperture is located within a heel area of said foot-supporting member.

28. The system of claim 27, wherein said heel area has a first compliance when said first insert portion is located within said aperture, and said heel area has a second compliance when said second insert portion is located within said aperture, said first compliance being less than said second compliance.

29. An article of footwear that is modifiable to have one of a first width and a second width, said footwear including an upper, a sole that is attached to said upper, and a foot-supporting member that is removable from said footwear, said foot-supporting member comprising:

a frame portion that underlies a substantial portion of a foot that is received by said footwear, said frame portion defining an aperture that extends from an upper surface of said frame portion to a lower surface of said frame portion;

a first insert portion and a second insert portion that have different widths, said aperture being configured to receive one of said first insert portion and said second insert portion, said footwear having said first width when said first insert portion is removably-received by said aperture, and said footwear having said second width when said second insert portion is received by said aperture; and a restraining member that is attached to at least a portion of one of said upper surface and said lower surface of said frame portion and unattached to said insert portions, said restraining member extending across said aperture to restrain one of said first and second said insert portions that is received by said aperture.

30. The article of footwear of claim 29, wherein said restraining member expands and contracts to accommodate increases and decreases in dimensions of said foot-supporting member.

31. The article of footwear of claim 29, wherein said upper surfaces of said insert portions are configured to align with said upper surface of said frame portion, and lower surfaces of said insert portions are configured to align with said lower surface of said frame portion.

32. The article of footwear of claim 29, wherein said first insert portion and said second insert portion are elliptically-shaped, said first insert portion having a greater eccentricity than said second insert portion.

33. The article of footwear of claim 32, wherein said first insert portion has a lesser width than said second insert portion.

34. The article of footwear of claim 32, wherein said first insert portion has a greater length than said second insert portion.

35. The article of footwear of claim 29, wherein said aperture generally extends along a center of a fore portion of said foot-supporting member.

36. The article of footwear of claim 29, wherein said frame portion includes a depression and said first and second insert portions each include a ridge that circumscribes said insert portions, one of said ridges being received by said depression when one of said insert portions is joined with said frame portion.

37. The article of footwear of claim 29, wherein said frame portion includes a ridge and said first and second insert portions each include a depression that circumscribes said insert portions, one of said depressions receiving said ridge when one of said insert portions is joined with said frame portion.

38. The article of footwear of claim 29, wherein said frame portion includes a protrusion and said first and second insert portions each include an indentation, said protrusion being received by one of said indentations when one of said insert portions is joined with said frame portion.

39. An article of footwear that is modifiable to have one of a first width and a second width, said footwear including an upper, a sole that is attached to said upper, and a foot-supporting member that is removable from said footwear, said foot-supporting member comprising:

a frame portion that underlies a substantial portion of a foot that is received by said footwear, said frame portion defining an aperture that extends from an upper surface of said frame portion to a lower surface of said frame portion;

a first insert portion and a second insert portion that are elliptically-shaped, said first insert portion having a greater eccentricity than said second insert portion, said aperture being configured to receive one of said first insert portion and said second insert portion, said footwear having said first width when said first insert portion is removably-received by said aperture, and said footwear having said second width when said second insert portion is received by said aperture; and a restraining member that is attached to at least a portion of one of said upper surface or said lower surface of said frame portion and unattached to said insert portions, said restraining member extending across said aperture to restrain one of said first and second said insert portions that is received by said aperture, said restraining member expanding and contracting to accommodate increases and decreases in dimensions of said foot-supporting member.

40. The article of footwear of claim 39, wherein interchanging said first insert portion with said second insert portion alters a dimension of said foot supporting member.

41. The article of footwear of claim 39, wherein said upper surfaces of said insert portions are configured to align with said upper surface of said frame portion, and lower surfaces of said insert portions are configured to align with said lower surface of said frame portion.

42. The article of footwear of claim 39 wherein said aperture generally extends along a center of a fore portion of said foot-supporting member.

43. The article of footwear of claim 39 wherein said aperture extends from an arch area of said foot-supporting member to a metatarsal area of said foot-supporting member.

44. The article of footwear of claim 39 wherein said frame portion includes a depression and said first and second insert potions each include a ridge that circumscribes said insert portions, one of said ridges being received by said depression when one of said insert portions is joined with said frame portion.

45. The article of footwear of claim 39 wherein said frame portion includes a ridge and said first and second insert portions each include a depression that circumscribes said insert portions, one of said depressions receiving said ridge when one of said insert portions is joined with said frame portion.

46. The article of footwear of claim 39 wherein said frame portion includes a protrusion and said first and second insert portions each include an indentation, said protrusion being received by one of said indentations when one of said insert portions is joined with said frame portion.

47. An article of footwear having variable fit characteristics, said footwear including an upper, a sole, and a removable foot-supporting member, said foot-supporting member comprising:

a frame portion that defines an aperture extending through said frame portion, said aperture extending from an upper surface of said frame portion to a lower surface of said frame portion;

a first insert portion, said first insert portion being removably-received by said aperture and interchangeable with a second insert portion, said first and second insert portions having different dimensions, and said footwear having a first set of dimensions when said first insert portion is received by said aperture and said footwear having a second set of dimensions when said second insert portion is received by said aperture, said first set of dimensions being accommodating a smaller foot than said second set of dimensions; and a restraining member formed of a continuous material, said restraining member being attached to at least a portion of an upper surface of said frame portion and unattached to upper surfaces of said insert portions, said restraining member extending over said aperture, and said restraining member expanding and contracting to accommodate increases and decreases in dimensions of said aperture.

48. The article of footwear of claim 47, wherein said sets of dimensions are widths of said footwear.

49. The article of footwear of claim 48, wherein said first insert portion has a lesser width than said second insert portion.

50. The article of footwear of claim 48, wherein said first insert portion and said second insert portion are elliptically-shaped, said first insert portion having a greater eccentricity than said second insert portion.

51. The article of footwear of claim 47, wherein said sets of dimensions are a length of said footwear.

52. The article of footwear of claim 51, wherein said first insert portion has a lesser thickness than said second insert portion.

53. The article of footwear of claim 52, wherein said foot-supporting member has a first length when said first insert portion is located within said aperture, and said foot-supporting member has a second length when said second insert portion is located within said aperture, said first length being less than said second length.

54. The article of footwear of claim 53, wherein said foot-supporting member has a third length when neither said first insert portion nor said second insert portion are located within said aperture, said third length being less than said first length and said second length.

55. The article of footwear of claim 47, wherein said sets of dimensions are an arch configuration of said footwear.

56. The article of footwear of claim 55, wherein said aperture is located within an arch area of said foot-supporting member.

57. The article of footwear of claim 55, wherein said arch area has a first height when said first insert portion is located within said aperture, and said arch area has a second height when said second insert portion is located within said arch area, said first height being less than said second height.

58. The article of footwear of claim 47, wherein said frame portion includes a depression and said first and second insert portions each include a ridge that circumscribes said insert portions, one of said ridges being received by said depression when one of said insert portions is joined with said frame portion.

59. The article of footwear of claim 47, wherein said frame portion includes a ridge and said first and second insert portions each include a depression that circumscribes said insert portions, one of said depressions receiving said ridge when one of said insert portions is joined with said frame portion.

60. The article of footwear of claim 47, wherein said frame portion includes a protrusion and said first and second insert portions each include an indentation, said protrusion being received by one of said indentations when one of said insert portions is joined with said frame portion.

61. A system for modifying at least one variable property of an article of footwear, said system comprising a foot-supporting member and an insert, said foot supporting member being removable from said footwear, and said foot-supporting member having a frame portion that defines an aperture for removably-receiving said insert portion, a property of said footwear being modified by inserting said insert portion into said aperture, and said foot-supporting member including a restraining member that is attached to at least a portion of an upper surface of said frame portion and unattached to an upper surface of said insert portion, said restraining member extending across said aperture to restrain movement of said insert portion when said insert portion is received by said aperture.

62. The system of claim 61, wherein said foot-supporting member includes a first said insert portion and a second said insert portion, said property of said footwear being modified by interchanging said first said insert portion with said second said insert portion.

63. The system of claim 61, wherein one of an upper and a sole restrain downward movement of said insert portion.

64. The system of claim 61, wherein said property is a dimension of said footwear.

65. The system of claim 64, wherein said dimension is one of a width and a length of said footwear.

66. The system of claim 61, wherein said restraining member expands and contracts to accommodate increases and decreases in dimensions of said foot-supporting member.

67. The system of claim 61, wherein said foot-supporting member has a first width when said insert portion is not received by said aperture, and said foot-supporting member has a second width when said insert portion is received by said aperture, said first width being less than said second width.

68. The system of claim 61, wherein said foot-supporting member has a first length when said insert portion is not received by said aperture, and said foot-supporting member has a second length when said insert portion is received by said aperture, said first length being less than said second length.

69. A system for modifying at least one variable property of an article of footwear, said system comprising a foot-supporting member and a plurality of insert portions, said foot supporting member being removable from said footwear, and said foot-supporting member having a frame portion that defines an aperture for removably-receiving one of said insert portions, said insert portions including a first insert portion and a second insert portion, said first insert portion having a first physical characteristic and said second insert portion having a second physical characteristic, and said first insert portion and said second insert portion being interchangeable within said aperture, differences in said physical characteristics modifying said at least one variable property, and said foot-supporting member including a restraining member that is attached to at least a portion of an upper surface of said frame portion and unattached to upper surfaces of said insert portions, said restraining member extending across said aperture to restrain movement of said one of said plurality of said insert portions that is received by said aperture.

70. The system of claim 69, wherein one of an upper and a sole restrain downward movement of said one of said plurality of said insert portions that is received by said aperture.

71. The system of claim 69, wherein said at least one variable property is a dimension of said footwear.

72. The system of claim 71, wherein said first physical characteristic and said second physical characteristic are dimensions of said insert portions, said dimensions of said insert portions being different to modify said at least one dimension of said footwear.

73. The system of claim 71, wherein said dimension is one of a width and a length of said footwear.

74. The system of claim 69, wherein said first physical characteristic is a compliance of said first insert portion, and said second physical characteristic is a compliance of said second insert portion, said compliance of said first insert portion and said compliance of said second insert portion being different.

75. The system of claim 69, wherein said restraining member expands and contacts to accommodate increases and decreases in dimensions of said foot-supporting member.

76. The system of claim 69, wherein said aperture extends from an upper surface of said frame portion to a lower surface of said frame portion.

77. The system of claim 76, wherein upper surfaces of said insert portions are configured to align with said upper surface of said frame portion, and lower surfaces of said insert portions are configured to align with said lower surface of said frame portion.

78. The system of claim 69, wherein said first insert portion and said second insert portion are elliptically-shaped, said first insert portion having a greater eccentricity than said second insert portion.

79. The system of claim 78, wherein interchanging said first insert portion with said second insert portion alters a dimension of said footwear.

80. The system of claim 78, wherein said foot-supporting member has a first width when said first insert portion is received by said aperture and said foot-supporting member has a second width when said second insert portion is received by said aperture, said first width being less than said second width.

81. The system of claim 69, wherein said aperture is located within an arch area of said foot-supporting member.

82. The system of claim 81, wherein said arch area has a first height when said first insert portion is located within said aperture, and said arch area has a second height when said second insert portion is located within said arch area, said first height being less than said second height.

83. The system of claim 69, wherein said aperture is located in a mid-portion of said foot-supporting member.

84. The system of claim 83, wherein said footwear has a first length when said first insert portion is located within said aperture, and said footwear has a second length when said second insert portion is located within said aperture, said first length being less than said second length.

85. The system of claim 69, wherein said aperture is located within a heel area of said foot-supporting member.

86. The system of claim 85, wherein said heel area has a first compliance when said first insert portion is located within said aperture, and said heel area has a second compliance when said second insert portion is located within said aperture, said first compliance being less than said second compliance.

* * * * *